US005168780A

United States Patent [19]

Van Gennep

[11] Patent Number: 5,168,780

[45] Date of Patent: * Dec. 8, 1992

[54] TOOL DRIVER WITH A DETACHABLE HANDLE HAVING A LIGHT

[76] Inventor: Jan Van Gennep, 715 Laurel Ave., Menlo Park, Calif. 94025

[ * ] Notice: The portion of the term of this patent subsequent to Nov. 12, 2008 has been disclaimed.

[21] Appl. No.: 704,313

[22] Filed: May 22, 1991

Related U.S. Application Data

[63] Continuation-in-part of Ser. No. 502,569, Mar. 30, 1990, Pat. No. 5,063,796, which is a continuation-in-part of Ser. No. 274,925, Nov. 22, 1988, Pat. No. 4,920,832.

[51] Int. Cl.[5] ..... B25B 17/00

[52] U.S. Cl. ..... 81/57.29; 81/58.1; 362/119; 362/120

[58] Field of Search ..... 81/57.29, 58.1, 177.4, 81/438, 490; 7/165; 362/119, 120

[56] References Cited

U.S. PATENT DOCUMENTS

| | | | |
|---|---|---|---|
| 719,275 | 1/1903 | Swan | 81/490 |
| 1,299,591 | 4/1919 | Malchow | 81/57.29 |
| 2,284,871 | 6/1942 | Huss | 81/57.29 |
| 2,670,427 | 2/1954 | Bartlet et al. | 362/120 |
| 2,696,859 | 12/1954 | Somma | 81/57.29 |
| 2,706,769 | 4/1955 | Cook | 362/120 X |
| 3,214,992 | 11/1965 | Dietrich | 81/57.29 X |
| 3,532,012 | 10/1970 | Pryor | 81/57.29 |
| 3,603,782 | 9/1971 | Wortmann | 362/120 |
| 4,283,757 | 8/1981 | Nalbandian et al. | 362/120 |
| 4,455,896 | 6/1984 | Holmes | 81/57.29 |
| 4,643,052 | 2/1987 | Badiali | 81/438 X |
| 4,722,035 | 1/1988 | Rapisarda | 362/119 X |
| 4,827,812 | 5/1989 | Markovetz | 81/490 X |

FOREIGN PATENT DOCUMENTS

| | | | |
|---|---|---|---|
| 482753 | 4/1938 | United Kingdom | 7/165 |
| 681319 | 10/1952 | United Kingdom | 81/177.4 |

*Primary Examiner*—James G. Smith

*Attorney, Agent, or Firm*—Flehr, Hohbach, Test, Albritton & Herbert

[57] ABSTRACT

A tool driver with a detachable handle for loosening and tightening fasteners or drilling holes in hard-to-reach locations. The tool driver contains a drive shaft and a mechanical means for converting force applied to the drive shaft to motion of a transverse tool attachment. A second tool attachment is located at one end of the drive shaft permitting a tool to be directly driven. A detachable handle is provided for stabilizing and controlling the tool driver. Additionally, the detachable handle is a container for a power source used to power a luminous element which illuminates the workpiece. Moreover, the detachable handle includes a means for attaching tools, so once detached, it serves as a device for driving tools in a manual fashion having a light.

11 Claims, 3 Drawing Sheets

TOOL DRIVER WITH A DETACHABLE HANDLE HAVING A LIGHT

CROSS REFERENCE TO RELATED APPLICATIONS

This application is a continuation-in-part of patent application Ser. No. 502,569 filed Mar. 30, 1990 for a Tool Driver With a Handle now U.S. Pat. No. 5,063,796, which is a continuation-in-part of patent application Ser. No. 274,925 filed Nov. 22, 1988 for a Tool Driver now U.S. Pat. No. 4,920,832.

The invention relates to a device for use in driving tools relative to workpieces. More particularly, this invention relates to such a device having a light and power source.

BACKGROUND OF THE INVENTION

Fasteners located in hard-to-reach locations are typically tightened or loosened using either a universal joint intermediary device, or via a mechanic's hands for lack of a better tool. However, a universal joint is only useful where the angle formed between the driver and the fastener is shallow, while hands are only useful to apply a small amount of torque. Moreover, in many situations a hand is too large to grasp a fastener in a restricted location. More recently a tool driver, U.S. Pat. No. 4,920,832, was developed as a solution to the aforementioned problems.

The tool driver described in such application is an intermediary device which is driven by a rotary driver, such as a socket wrench or drill. The device translates the torque supplied by the driver to a transversely attached tool. A number of tool types may be used. For example, the tool could be a socket to interact with a nut or it could be a screwdriver bit.

The tool driver is a superb device for tightening and loosening hard to reach fasteners. However, at times a large amount of force must be applied along the tool and fastener rotational axis to initiate tightening or loosening. It also has been found that aligning a fastener or drill bit can be difficult when the desired location is restricted or partially hidden from view. To solve these difficulties, a handle is added to the tool driver as described in U.S. Pat. No. 5,063,796.

Typically, the hard-to-reach locations are not illuminated very well. Consequently, artificial lighting must be provided by the mechanic. In close quarters, this can be a difficult task. A means for providing illumination of the work piece, where the luminous element is attached to the handle of the tool driver, is helpful. The tool driver described in the above application does not have this attribute.

In many applications, a mechanic uses multiple types of manually operated tools in conjunction with the aforementioned tool driver. These other tools include screw drivers, nut drivers, and the like. It would be advantageous for the mechanic to have easily accessible a manually operated device for driving tools which compatibly accepts the same assortment of tool bits as are used in conjunction with the tool driver. To facilitate having an accessible manually operated tool driver and improve the versatility of the tool driver, it would be desirable to have the manually operated tool driver attached to the tool driver as a detachable handle. In addition, it would be advantageous to have the manually operated tool driver have a light such that it illuminates both the work area of the manually operated tool driver when detached from the tool driver, and the work area of the tool driver while the manually operated tool driver is attached to the tool driver. The tool drivers described in U.S. Pat. Nos. 4,920,832 and 5,063,796 do not have these attributes.

SUMMARY OF THE INVENTION

In order to improve the above-discussed tool driver, the present invention incorporates apparatus in the form of a handle for stabilizing and controlling the tool driver, as well as providing a detachable tool driver which is manually operable. The tool driver includes a drive shaft and a mechanical means for converting force applied to the drive shaft to motion of a transverse tool attachment. Preferably, a second tool attachment is located at one end of the direct drive shaft permitting a tool to be directly driven. Each tool attachment desirably is designed to enable a variety of tools to be used and easily interchanged with other tools.

In accordance with one aspect of the invention, the handle itself can be utilized as a device for driving tools in a manual manner. The handle has incorporated into one end a tool attachment means which is compatible with the tool attachment means of the tool driver. Thus, tools which are used in conjunction with the tool driver are also usable in conjunction with the handle when it is used as a manually operated tool driver.

In keeping with another aspect of the invention, the handle acts as a container for a battery, or batteries, used to power a luminous element. The luminous element is attached to one end of the handle in a location that provides illumination of the workpieces associated with both the directly and indirectly driven tools. Moreover, the luminous element, being attached to the handle, provides illumination for the work area when the handle is detached and used as a device for manually driving tools.

In accordance with another aspect of the invention, the handle having a luminous element attached to one end can be utilized as a device for driving tools in a manual manner. The power source for the luminous element is contained within the handle and a switch means, located on the end of the handle opposite the luminous element, selectably connects the power source to the luminous element. Most simply, the switch means physically moves the power source to establish a closed electrical circuit which passes current through the luminous element.

BRIEF DESCRIPTION OF THE DRAWINGS

Additional objects and features of the invention will be more apparent from the following detailed description and appended claims when taken in conjunction with the drawings, in which:

DESCRIPTION OF THE PREFERRED EMBODIMENT

Figure 1:
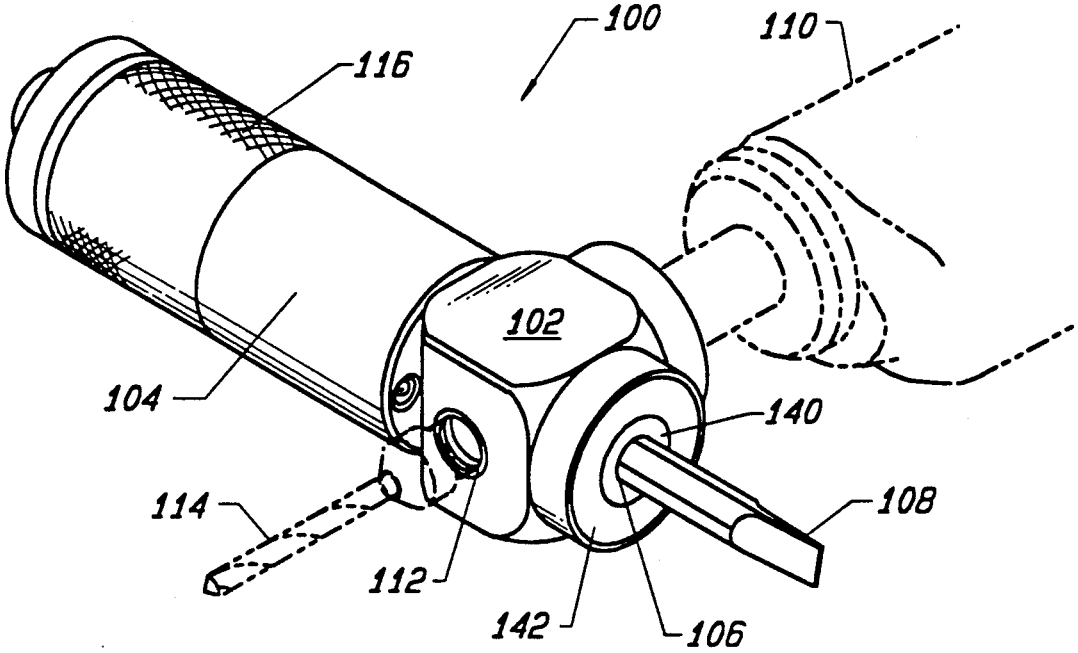
FIG. 1 is an isometric view illustrating a tool driver in accordance with the present invention, in combination with a rotary driver.

Referring to FIG. 1, there is shown a preferred embodiment of the tool driver apparatus 10 of the present invention. It includes mechanical means (not shown in FIG. 1) enclosed in a housing 100 for translating force, a detachable handle 104, and apparatus 106 for attaching a tool 108 transverse to the driving implement represented at 110. Additionally, apparatus 112 for attaching a tool 114 generally axially relative to the driving implement 110 is included.

Figure 2:
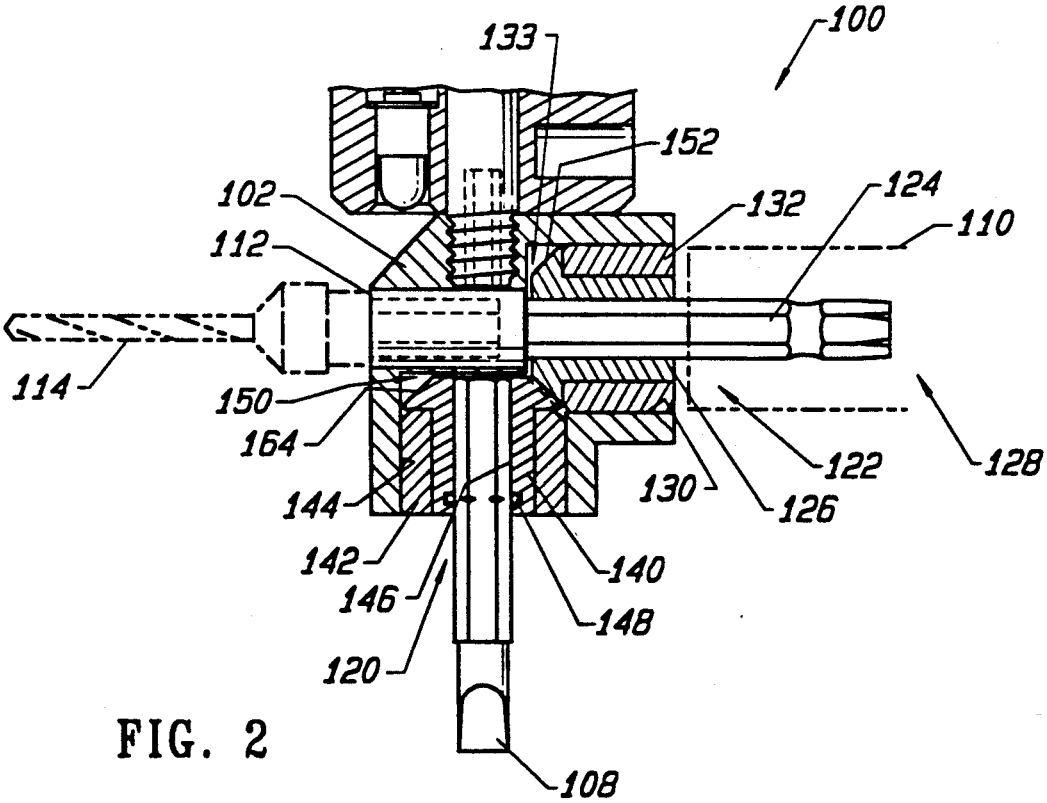
FIG. 2 is a cross-sectional view of the tool driver of FIG. 1.

In the preferred embodiment, the detachable handle 104 is attached to the housing 102 opposite the indirectly driven tool 108 to provide stability, leverage, and easy tool alignment during operation. The detachable handle includes a means for gripping. Such means take the form of a knurled surface 116. However, such means may also be accomplished by conforming the surface to better fit into the palm of a hand. Additionally, the detachable handle 104 is constructed to be separable from the tool driver housing 102. FIG. 2 depicts the detachable handle 104 as attached by threads allowing easy removal when it is necessary to fit the tool driver 100 into close quarters or when it is desirable to utilize the handle as a manually operated device for driving tools, as discussed below. Moreover, the detachable handle 104 is preferably a hollow right circular cylinder constructed of a non-magnetic material such as aluminum.

The preferred embodiment of the tool driver 100, as shown in the section view of FIG. 2, has a housing 102 enclosing an indirect driving portion 120 and a direct drive portion 122. The housing 102 protects a user's hands from the harm that could be inflicted by the meshing gears of the force converting mechanism and provides a means for holding the gears together. Although from the broad standpoint the driving mechanism could be designed to translate force of any kind to transverse motion, in this preferred embodiment it converts torque to transverse rotary motion. To this end, the direct driving portion 122 includes a direct drive shaft 124 extending through the housing 102, which is integral with the first bevel gear 126. The direct drive shaft 124 includes a rotary drive receiving end 128, adapted for connection to a rotary driver such as a drill 110 or ratchet wrench, and a tool connector end 112, adapted to receive a tool to tighten/loosen fasteners or drill holes. Connector 110 is disposed within the housing 102.

The first bevel gear 126 is positioned in bore 130. The bevel gear 126 is held in place by a needle bearing assembly 132 which is press fit into the bore 130. The needle bearing assembly 132 supports the bevel gear 126 and maintains a space 133 between the bevel gear 126 and the housing 102. The direct drive shaft 124 is integrally coupled to the bevel gear 126 such that when the shaft 124 is rotated, the first bevel gear 126 also rotates. Preferably, the direct drive shaft 124 is a standard hex drive bit holder. However, the direct drive shaft 124 is removable so that other types of shafts with varying types of tool connector ends 112 may be used. For instance, the hex drive bit holder 124 could be replaced with a shaft that has a threaded bit holder end providing a more stable tool holder than the hex bit holder. Stability of the bit holder is of paramount importance in some drilling applications.

The indirect driving portion 120 includes a second bevel gear 140 held in place by a needle bearing assembly 142. The needle bearing assembly 142 is press fit into a bore 144 in the housing 102. The second bevel gear 140 includes an integral tool connector 146 and a locking ring 148 to hold the tool 108 in place. The tool 108 extends through the second bevel gear 140 and protrudes from the second bevel gear 140 engaging the housing 102 at a point of rotation. This configuration maintains a small space 150 between the second bevel gear 140 and the housing 102 such that the bevel gear 140 will not destroy the housing 102 through friction. Preferably, the tool connecter 146 is a hex bit holder. However, a threaded bit holder can also be fashioned as an integral portion of the second bevel gear 140. The threaded bits do not protrude from the second bevel gear due to manufacturing standards for the bit holders. To provide a low friction point of rotation, a ball bearing is positioned at the pivot of the second bevel gear 140 to maintain the space 150 between the bevel gear 140 and the housing 102.

Both bevel gears 126, 140 and their associated needle bearings 132, 142 are positioned in the housing 102 such that the teeth 152 of the first bevel gear 126 mesh with the teeth 164 of the second bevel gear 140. Thus, when the first bevel gear 126 is rotated via the direct drive shaft 124, the second bevel gear 140 will also rotate and vice versa.

In operation, either the directly driven tool 114 or the indirectly driven tool 108 may be used to tighten or loosen fasteners or drill holes. In either case, a rotary driver 110, such as a drill or a socket wrench, is attached to the direct drive shaft 124. The applied torque will be transferred either to a tool mounted in the direct drive tool connector 112 or the indirect drive tool connector 146. The driving element's direction of motion is transferred to the indirect tool by means of the meshing bevel gears 126 and 140. A tool mounted in either position will rotate and facilitate tightening or loosening fasteners or drilling holes. In some instances, it may be desirable to attach both indirect 108 and direct 114 tools at the same time.

The preferred embodiment can be used to drive various types of fasteners. For example, the invention can be used to tighten or loosen nuts, bolts, screws, and the like. In addition, a drill bit can be inserted into either tool connector 146 or 112 enabling holes to be drilled indirectly or directly. Furthermore, enhanced versatility is achieved by using the tool driver in conjunction with snakes or universal joints. In other words, the tool driver can be employed in any application in which a device is driven or rotated.

Figures 3, 3A:
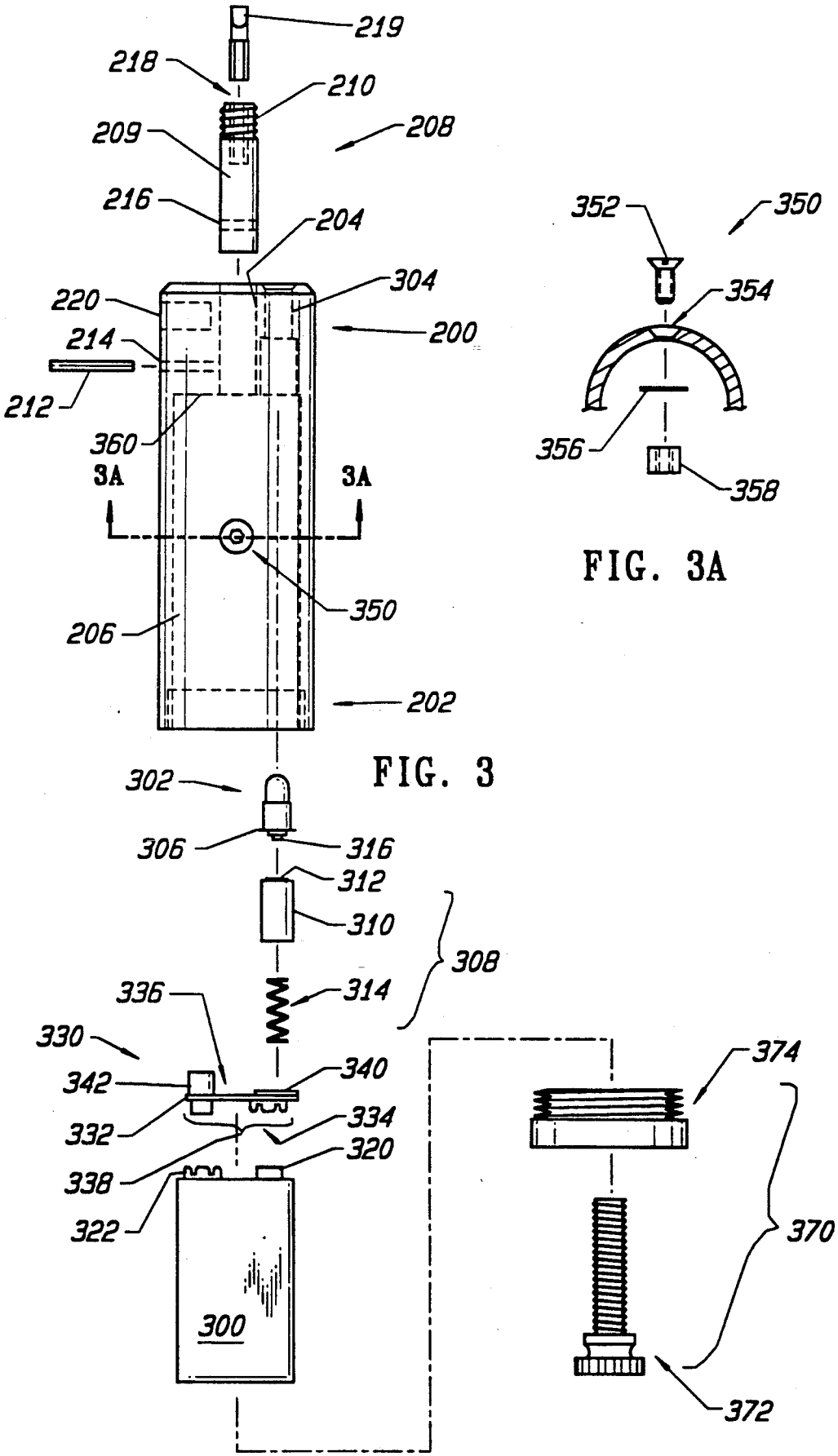
FIG. 3 is an exploded view of the handle.
FIG. 3A is a cross-sectional view taken on the plane indicated by the line 3A—3A in FIG. 3 more clearly depicting the keeper which maintains the position of the battery.

Referring to FIG. 3, there is depicted an exploded view of the detachable handle. The detachable handle 104 includes a hollow right circular cylinder having a substantially closed first end 200 and an essentially open second end 202. To facilitate installation of a tool attachment means 208, a bore 204 extends through the first end and into the cavity 206 of the handle 104. The tool attachment means 208 comprises a cylindrical portion 209 having one end threaded on the outer surface 210 and the remaining surface smooth to facilitate press fitting into the bore 204. To ensure that the cylindrical portion 209 cannot rotate in the bore 204 during use, a pin 212 is inserted through a second bore 214 to interact with a bore 216 in the cylindrical portion 209.

Figure 4:
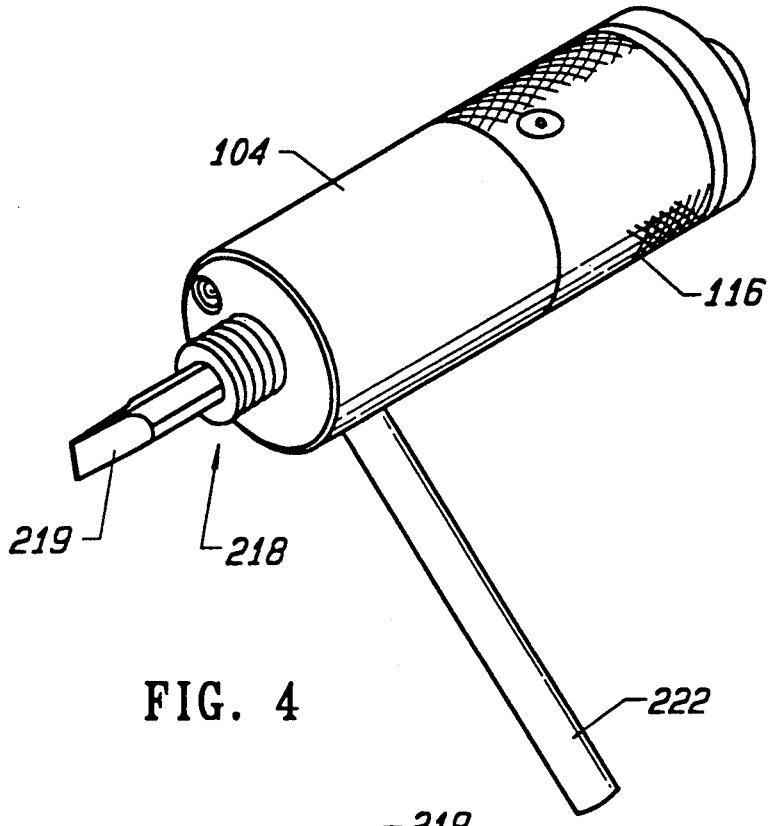
FIG. 4 is an isometric view of the handle being utilized as a device for driving tools.

To facilitate use of the handle separately as a manually operated tool driver, the cylindrical portion 209 has tool connector 218 formed by the shaped inner surface of the cylindrical portion 209. The tool connector 218 of the handle 104 is substantially similar to the configurations of the tool connectors 146 and 112 of the tool driver 100, i.e., preferably, a standard hex bit connector. Thus, tools which are used with the tool driver 100 will be compatible with the manually operated tool driver 104. This arrangement provides a mechanic great versatility from a single instrument. FIG. 4 depicts an isometric view of the detachable handle being used as a device for driving tools. The standard hex bit tool, depicted is a screwdriver bit 219, fits snugly into the tool connector 218. A similar locking ring to that shown as reference 148 in FIG. 2 may be incorporated into the tool connector 218 to reliably hold the tool 219 in place.

At times, a mechanic may come across fasteners which are not easily removable by the manual tool driver 104 because not a great enough torque is provided by a wrist. To enable large torques to be applied to fasteners while still using the handle as a manually operated tool driver, a bore 220 capable of accepting a "breaker bar" 222 is provided. The "breaker bar" 222 is inserted into the bore 220, as depicted in FIG. 4, enabling a second hand to be used to provide a force at a greater radius from the fasteners axis of rotation.

Continuing with reference to FIG. 3, note that the cavity 206 of the detachable handle 104 is used as a container for a power source 300. Preferably, the power source 300 is a standard 9 volt battery. The battery 300 is used to power a means for illuminating the workpiece. Such means for illuminating may be a light emitting diode. In the preferred embodiment, an incandescent light bulb 302 is positioned on the detachable handle 104 such that the work pieces associated with either the direct 114 or indirect 108 tool would be illuminated, as well as illuminating any work piece associated with the handle when its used as a manually operated tool driver.

To mount the light bulb 302 on the handle 104, a bore 304 is provided in the first end 200 of the handle 104 extending into the cavity 206. The bore 304 is beveled at the surface to better disperse the light and illuminate a large portion of the work area. To provide support for the light bulb 302, the bore 304 has two radii. The first radius is large enough to allow the lamp 304, when inserted into the bore 304, to be flush with the surface of the first end 200 of the handle 104. A flange 306 on the light bulb 302 has a larger radius than the first radius of the bore 304, but fits through the second radius portion of the bore 304. Thus, the flange 306 of the bulb maintains the bulbs position and provides a ground (negative) contact to the metallic handle 104 for the light bulb 302. A contact assembly 308 having a cylindrical non-conductive portion 310 with a conductive core element 312 is inserted into the bore 304 behind the light bulb 302. The non-conductive portion 310 has an outer radius substantially equivalent to the second radius of the bore 304, such that the assembly 308 fits snugly in the bore 304 and maintains contact between the light bulb electrical contact 316 and the conductive core 312. To ensure that contact is maintained, a spring 314 is attached to the conductive core 312 to provide a positive contact to the battery 300 and to provide a force upon the contact assembly 308 to maintain electrical contact with the light bulb 302.

In summary, the positive terminal 320 of the battery 300 is connected to the incandescent lamp 302 via a contact assembly 308. The spring 314 provides pressure to the battery 300 maintaining contact between the positive battery voltage and the incandescent light bulb 302. To complete the electrical circuit and turn on the light bulb 302, the negative voltage of the battery 300 is connected to the metallic handle 104 via connector assembly 330.

Figure 5:
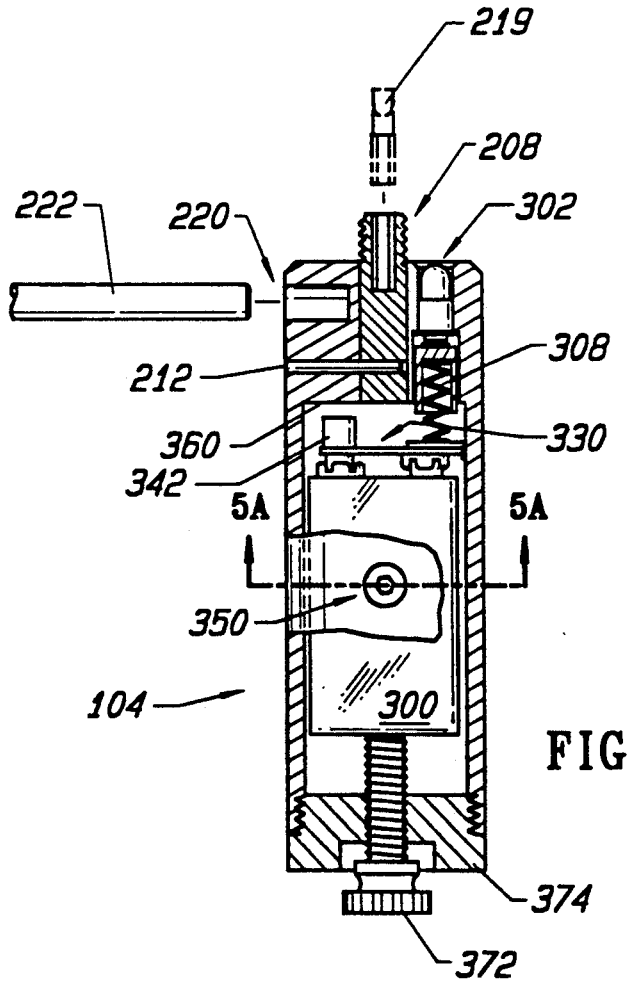
FIG. 5 is a cross-sectional view of the handle.
Figure 5A:
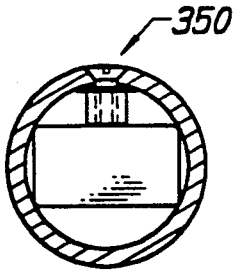
FIG. 5A is a cross-sectional view taken on the plane indicated by the line 5A—5A in FIG. 5 more clearly depicting the keeper which maintains the position of the battery.

The connector assembly 330 is comprised of a non-conductive substrate 332 having a first side 334 and a second side 336, a connector 338 mating with the positive and negative terminals 320 and 322 of the battery 300 located on the first side 334 of the substrate 332, a conductive plate 340 located on the second side 336 of the substrate 332 and connected through the substrate 332 to the positive terminal 320 of the battery 300 via the connector 338, and a conductive protrusion 342 located on the second side 336 of the substrate 332 and connected to the negative terminal 322 of the battery 300 via the connector 338. The conductive plate 340 forms a mating surface for the spring 314 to indirectly attach the light bulb contact 316 to the positive terminal 320 of the battery 300. Alignment of the plate 340 and the spring 314 is maintained by a keeper 350. In the preferred embodiment depicted in FIG. 3A, the keeper 350 is a screw 352 inserted in a hole 354 in the side surface of the handle 104 and threaded into a washer 356 and nut combination 358. To maintain the alignment of the battery 300 and the spring 314, the keeper, as depicted in FIG. 5A, extends into the cavity 206 far enough to ensure that the battery 300 will not rotate within the cavity 206.

Conductive protrusion 342 contacts the cavity wall 360 to complete the electrical circuit and activate the light 302. Contact between the protrusion 342 and the cavity wall 360 is controlled by a switch means 370. The switch means 370, in its simplest form, physically moves the battery 300 and connector assembly 330 until the protrusion 342 makes contact with the metallic surface of the cavity wall 360. Preferably, the movement of the battery 300 and connector assembly 308 is accomplished using a screw 372 threaded into a cap 374. The cap 374 is threaded to match threads on the inside surface of the second end 200 of the handle. Thus, the cap 374 is removable to facilitate access to the power source 300 to allow for replacement. The cross section view of the handle shown in FIG. 5 best depicts the switch means arrangement.

In operation, the screw 372 is turned clockwise to push the battery 300 upward until contact is made between the cavity wall 360 and the protrusion 342 forming the closed electrical circuit to apply power to the light bulb 302. Subsequently turning the screw 372 counterclockwise turns the light bulb 302 off. Other switch means such as slide switches, toggle switches, and push button switches are contemplated as alternatives to the switch means depicted in FIG. 5. The switch means as described in connection with the preferred embodiment should not be construed to limit the scope of the invention. However, the switch means as described provides an arrangement which accomplishes the switching function exceptionally well with a very simple, rugged, low cost design.

While the present invention has been described with reference to a few embodiments, the description is illustrative of the invention and is not to be construed as limiting the invention. Various modifications may occur to those skilled in the art without departing from the true spirit and scope of the invention as defined by the claims.

What is claimed is:

1. A device for driving tools comprising:

a drive shaft enabling attachment of a driving implement to the device;

first means for attaching a tool transverse to said drive shaft;

second means for attaching a tool generally axially relative to said drive shaft;

means for converting driving force applied to said drive shaft to movement of said first attachment means on a driving axis transverse to said drive shaft;

a housing encasing the force converting means;

said means for converting driving force including first and second bevel gears rotatably mounted in said housing and meshing with one another, the first bevel gear being attached to said drive shaft and the second one of said gears being attached to said means for attaching a tool transverse to said drive shaft and being supported by a bearing at a location spaced from said housing;

a handle securable to said housing so as to facilitate operation of a tool attached to either, or both, of said tool attachment means, which handle defines a cavity;

means for detachably attaching said handle to said housing;

an incandescent lightbulb attached to said device, positioned to project illumination from said handle to a location at which a tool attached by said first or second means interacts with a workpiece;

a power source positioned in said cavity to supply power to said luminous element; and switching means for selectably applying power from said power source to said luminous element.

2. The device of claim 1 wherein said handle is locatable on said housing generally coaxial with said transverse driving axis to facilitate manual control of a tool at said transverse attachment means.

3. The device of claim 1 wherein said handle is essentially cylindrical in shape and defines a cavity having a substantially closed first end and a essentially open second end, said means for detachably attaching is centrally located upon said substantially closed first end, said switch means is attached to said essentially open second end, and said luminous element is attached to said first end.

4. The device of claim 3 wherein said first end further includes a tool attachment means for attaching a tool such that said handle is useful as a device for driving tools.

5. The device of claim 1 wherein said handle has a surface configuration which facilitates gripping.

6. The device of claim 1 wherein said power source is a battery within said cavity.

7. The device of claim 1 wherein said switch means includes means for physically moving said power source to form a closed electrical circuit to apply power from said power source to said lightbulb.

8. The device of claim 7 wherein said means for moving said power source is a screw threaded into a cap attached to said second end of said handle.

9. A device for driving tools comprising:

an essentially cylindrical handle defining a cavity therewithin having a substantially closed first end, an essentially open second end, and an exterior surface configuration facilitating manual gripping;

a luminous element attached to said device, positioned to project illumination from said first end of said essentially cylindrical cavity to a location at which a tool driven by said device interacts with a workpiece;

a battery positioned in said cavity to supply power to said luminous element;

means for attaching a tool to said first end aligned coaxially with said essentially cylindrical portion;

a cap portion detachable attached to said second end to permit removal of said battery;

a connector for electrically connecting said battery to said luminous element, which connector includes a conductive protrusion; and switch means for selectively applying power from said battery through said conductive protrusion to said luminous element, said switch means includes means for physically moving said conductive protrusion to form a closed electrical circuit to apply power from said battery to said luminous element.

10. The device of claim 9 wherein said means for moving said battery and connector is a screw threaded into said cap.

11. The device of claim 9 wherein said luminous element is an incandescent light bulb.

* * * * *